US010483616B2

(12) United States Patent
Ozaki et al.

(10) Patent No.: US 10,483,616 B2
(45) Date of Patent: Nov. 19, 2019

(54) ILLUMINATION DEVICE

(71) Applicant: PANASONIC INTELLECTUAL PROPERTY MANAGEMENT CO., LTD., Osaka (JP)

(72) Inventors: Hajime Ozaki, Osaka-fu (JP); Tatsumi Setomoto, Osaka-fu (JP); Satoru Yamauchi, Osaka-fu (JP); Hironori Akiyama, Osaka-fu (JP); Kohji Hiramatsu, Osaka-fu (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/221,089

(22) Filed: Dec. 14, 2018

(65) Prior Publication Data

US 2019/0190118 A1 Jun. 20, 2019

(30) Foreign Application Priority Data

Dec. 19, 2017 (JP) ..... 2017-242739
Mar. 26, 2018 (JP) ..... 2018-058626

(51) Int. Cl.

| | |
|---|---|
| ***H01Q 1/22*** | (2006.01) |
| ***F21V 23/00*** | (2015.01) |
| ***F21K 9/23*** | (2016.01) |
| ***H05B 37/02*** | (2006.01) |
| *F21Y 115/10* | (2016.01) |

(52) U.S. Cl.
CPC ..... *H01Q 1/22* (2013.01); *F21K 9/23* (2016.08); *F21V 23/003* (2013.01); *F21Y 2115/10* (2016.08); *H05B 37/0272* (2013.01)

(58) Field of Classification Search
None
See application file for complete search history.

(56) References Cited

U.S. PATENT DOCUMENTS

2013/0328481 A1* 12/2013 Hiroi ..... H05B 37/0272 315/34
2018/0177309 A1* 6/2018 Paris ..... A47F 3/001

FOREIGN PATENT DOCUMENTS

JP 2014-167878 9/2014

* cited by examiner

*Primary Examiner* — Dedei K Hammond
(74) *Attorney, Agent, or Firm* — Greenblum & Bernstein, P.L.C.

(57) ABSTRACT

An illumination device is provided. The illumination device includes a substrate including a light-emitter. An instrument main body includes a substrate arrangement surface, with the substrate being on the substrate arrangement surface. A cover is attached to the instrument main body, covers the substrate, and is transparent. An antenna is on the cover and configured to receive a signal from an outside of the illumination device. A driver is on the instrument main body and configured to supply power to the light-emitter. A controller is configured to control the power supplied from the driver to the light-emitter based on the signal received by the antenna. The cover includes a diffusion factor from 40% to 90%.

17 Claims, 13 Drawing Sheets

ILLUMINATION DEVICE

CROSS REFERENCE TO RELATED APPLICATION

The entire disclosures of Japanese Patent Application No. 2017-242739 filed on Dec. 19, 2017, and Japanese Patent Application No. 2018-058626 filed on Mar. 26, 2018, including the specification, claims, drawings, and abstract, are incorporated herein by reference in their entirety.

TECHNICAL FIELD

The present disclosure relates to an illumination device including an antenna.

BACKGROUND

Hitherto, JP 2014-167878 A discloses an illumination device including an antenna. It is described that the illumination device includes a light source that irradiates the outside with light, a base section having a mounting surface on which the light source is mounted, a cover portion formed so as to cover the light source and mounted on a lower side of the base section, a wireless communication unit that communicates with a wireless terminal, and a location information transmitter that transmits location information of the wireless terminal. A location information transmitter including a pattern antenna is provided on the cover.

In JP 2014-167878 A, when the antenna of the location information transmitter is arranged close to a base portion provided on an end portion of the illumination device, the transmission range of a wireless signal that can be transmitted from the antenna is restricted by the base portion. Therefore, the location information transmitter including the antenna is arranged on the center of the cover in a length direction thereof.

SUMMARY

Technical Problem

When the antenna is arranged on the cover, as in the illumination device disclosed in JP 2014-167878 A, the cover has transparency, and hence there is a need to prevent the design of the illumination device from deteriorating as a result of providing the antenna on the cover.

It is an advantage of the present disclosure to provide an illumination device capable of suppressing the deterioration of the design by making an antenna arranged on a cover having transparency inconspicuous.

Solution to Problem

An illumination device according to the present disclosure includes: a substrate including a light-emitting unit; an instrument main body having a substrate arrangement surface on which the substrate is arranged; a cover that is attached to the instrument main body so as to cover the substrate and that has transparency; an antenna arranged on the cover and configured to receive a signal from an outside; a drive device mounted on the instrument main body and configured to supply power to the light-emitting unit; and a control device configured to control power supply from the drive device to the light-emitting unit on the basis of the signal received by the antenna, and the cover has a diffusion factor of from 40% to 90%.

Advantageous Effects of Invention

According to the illumination device according to the present disclosure, the antenna arranged on the cover having transparency becomes inconspicuous, and the deterioration of the design may be suppressed.

BRIEF DESCRIPTION OF DRAWINGS

Embodiments of the present disclosure will be described based on the following figures, wherein.

DESCRIPTION OF EMBODIMENTS

Embodiments according to the present disclosure are described in detail below with reference to the attached drawings. In the description, specific shapes, materials, numerical values, directions, and the like are examples for facilitating the understanding of the present disclosure, and can be modified, as appropriate, in accordance with the application, the purpose, the specification, and the like. In addition, when a plurality of embodiments, modified examples, and the like are included below, it is assumed from the beginning that features thereof are used in combination, as appropriate.

Figure 1:
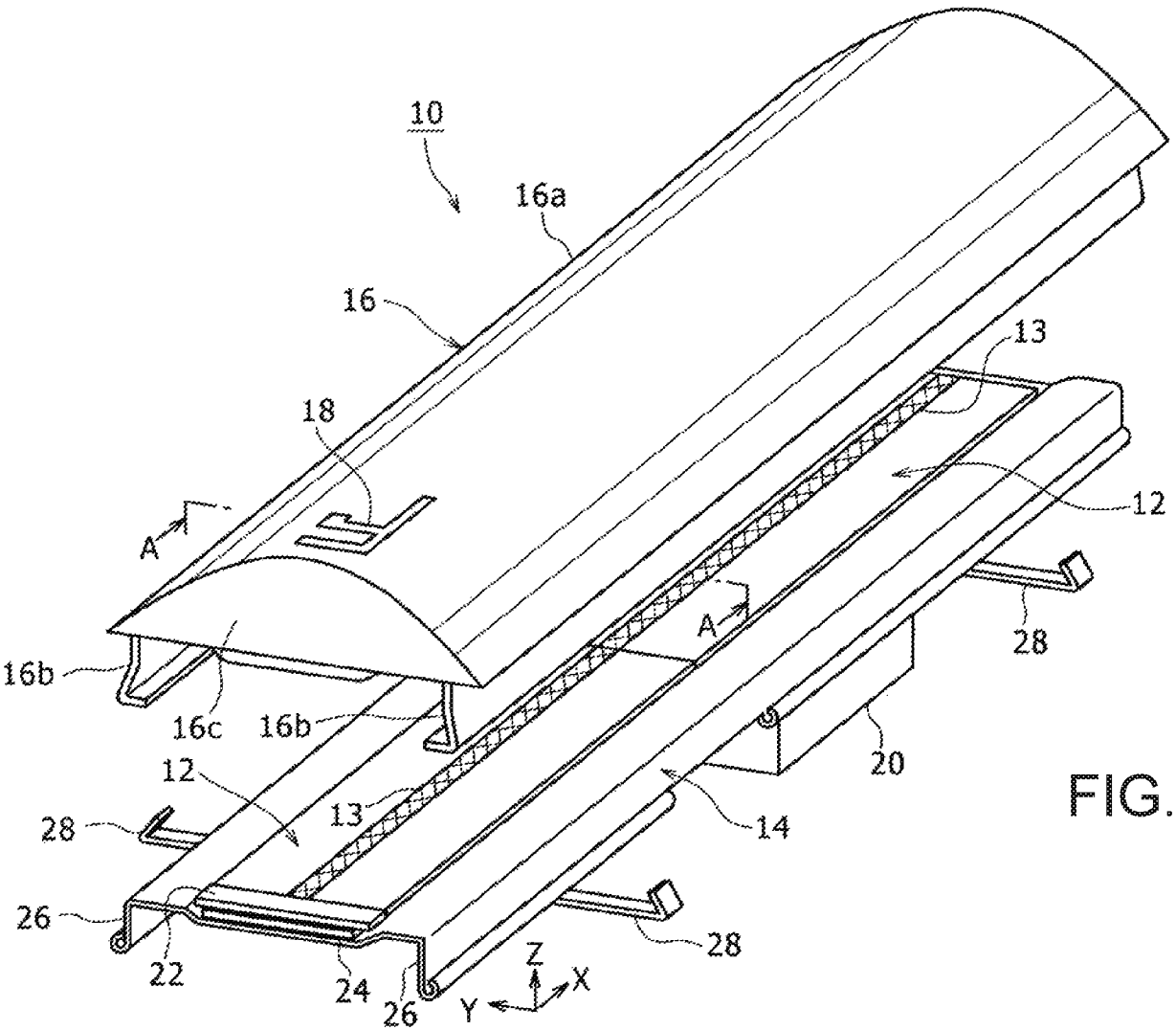
FIG. 1 is an exploded perspective view of an illumination device of a first embodiment.
Figure 2:
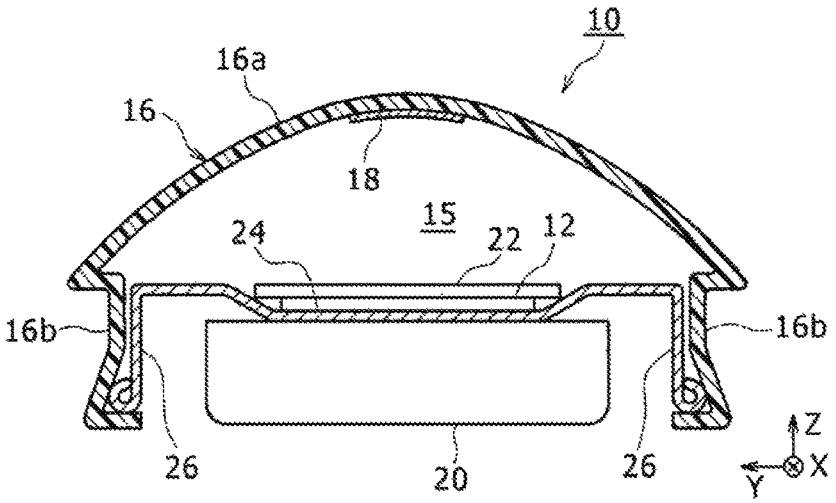
FIG. 2 is a sectional view of the illumination device illustrated in FIG. 1 in an assembled state taken along line A-A.

FIG. 1 is an exploded perspective view of an illumination device 10 of a first embodiment, and FIG. 2 is a sectional view of the illumination device 10 illustrated in FIG. 1 in an assembled state taken along line A-A. In FIG. 1 and FIG. 2 (the same applies to FIG. 3 to FIG. 14), a length direction X and a width direction Y orthogonal to each other in a horizontal plane, and a height direction Z orthogonal to those two directions, are shown.

As illustrated in FIG. 1, the illumination device 10 includes a substrate 12, an instrument main body 14, a cover 16, an antenna 18, a drive device 20, and a control device 22.

The substrate 12 includes a light-emitting unit 13. The light-emitting unit 13 is formed so as to extend in the length direction X on the center, in the width direction Y, of the substrate 12. The light-emitting unit 13 can be formed by a COB (Chip on Board) structure in which a plurality of light-emitting elements arranged at intervals in the length direction X are sealed by being covered with a resin material. For example, a light-emitting diode (LED), an organic EL (Electro Luminescence) element, and the like can be used for the light-emitting element. In addition, a wiring pattern (not shown) is formed on the substrate 12, and power can be supplied to the plurality of light-emitting elements included in the light-emitting unit 13. Note that the structure of the light-emitting unit 13 is not limited to the COB structure, and may be other structures such as a SMD (Surface Mount Device), for example.

In this embodiment, an example in which two substrates 12 are arranged so as to be adjacent to each other in the length direction X is described. The substrates 12 are electrically connected by a connector and the like, for example. Note that the number or the connection structure of the substrates 12 included in the illumination device 10 may be modified, as appropriate, in accordance with the shape, the size, and the like of the illumination device.

The instrument main body 14 is formed to have an oblong shape that is long and narrow in the length direction X in planar view. The instrument main body 14 is formed by bending a metallic plate such as an aluminum plate, for example. The instrument main body 14 has a flat substrate arrangement surface 24 on which the substrate 12 is arranged. The substrate 12 is fixed on one surface of the substrate arrangement surface 24 by adhesion, an adhesive tape, screw clamping, and the like, for example.

The instrument main body 14 has bent portions 26 that are bent at a substantial right angle on both sides of the substrate arrangement surface 24 in the width direction Y. The bent portions 26 are formed over the entire length of the instrument main body 14 in the length direction X. The stiffness of the instrument main body 14 can be increased by forming the bent portions 26 on both sides in the width direction Y, as above.

In the instrument main body 14, distal end portions of the bent portions 26 are bent to be substantially circular when seen from the length direction X. The illumination device 10 can be safely handled at the time of the construction and the like by making the distal end portions of the bent portions 26 round, as described above. In addition, a plurality of attachment portions 28 are provided on the instrument main body 14 so as to protrude from both sides in the width direction Y. The illumination device 10 can be attached to the ceiling and the like with use of the attachment portions 28.

The cover 16 is a member that has transparency, and the light emitted from the light-emitting unit 13 of the substrate 12 irradiates the outside via the cover 16. The cover 16 is integrally molded by a resin material such as an acrylic resin, for example.

The cover 16 integrally includes a cover portion 16*a* curved into a cylindrical surface shape, attachment portions 16*b* protruding from both sides of the cover portion 16*a* in the width direction along the height direction Z, and side surfaces 16*c* provided so as to close both end portions of the cover portion 16*a* in the length direction. The distal ends of the attachment portions 16*b* are formed to be hook portions bent in the width direction Y, and the cover 16 is attached to the instrument main body 14 by engaging the hook portions with the distal ends of the bent portions 26 of the instrument main body 14.

At least the cover portion 16*a* of the cover 16 has a predetermined diffusion factor. In this embodiment, the diffusion factor of the cover portion 16*a* is set to be from 40% to 90%. When the cover portion 16*a* has a diffusion factor as above, the antenna 18 becomes difficult to see from the outside of the illumination device 10 and the antenna 18 provided on the cover 16 becomes inconspicuous. As a result, the deterioration of the design of the illumination device 10 can be suppressed. The diffusion factor of the cover portion 16*a* can be set to be in a predetermined range by adjusting the amount of diffusion materials such as silica and calcium carbonate, for example, dispersed in the resin material forming the cover 16. The "diffusion factor" is herein a value obtained from the light distribution of transmitted diffusion light when a sample is perpendicularly irradiated with parallel light, and can be obtained with the expression below from the light intensities when the emission angle is 5 degrees, 20 degrees, and 70 degrees:

$$\text{diffusion factor } D=\{(B70+B20)/2\}/B5\times 100$$

where B70 represents a light intensity when the emission angle is 70 degrees, B20 represents a light intensity when the emission angle is 20 degrees, and B5 represents a light intensity when the emission angle is 5 degrees.

The antenna 18 has a function of receiving a wireless signal transmitted from a transmitter outside the illumination device 10. The wireless signal includes information on the lighting of the illumination device 10 (for example, lighting, lighting-off, dimming, blinking, and the like). In this embodiment, the antenna 18 having an inverted F pattern is exemplified, but the present invention is not limited thereto and an antenna having any pattern may be used.

The antenna 18 is provided on the cover 16. In more detail, the antenna 18 is arranged on an inner surface of the cover portion 16*a* that is in contact with a space 15 formed between the substrate arrangement surface 24 of the instrument main body 14 and the cover portion 16*a* as illustrated in FIG. 2. In addition, on the inner surface of the cover portion 16*a*, the antenna 18 is provided in a position facing the substrate arrangement surface 24 of the instrument main body 14. The antenna 18 is formed as a metal film pattern, and can be arranged on the inner surface of the cover portion 16*a* by printing, deposition, pasting, and the like, for example. By arranging the antenna 18 on the inner surface of the cover portion 16*a* as above, damage can be suppressed because the antenna 18 is less likely to be touched by a hand of a person at the time of the construction. As a result, the occurrence of a communication failure can be suppressed.

In addition, the metal film may be opaque, or may be a transparent metal film such as an ITO (indium tin oxide) film, for example. The width of a conductive pattern line forming the antenna 18 is preferably from 0.1 mm to 0.5 mm. By the configuration as above, the antenna 18 becomes less visible from the outside of the illumination device 10, and the design deterioration of the illumination device 10 can be suppressed.

Note that the antenna 18 may be arranged on an outer surface of the cover 16. In that case, the antenna 18 is preferably protected by being covered with a transparent film material and the like, for example, so as not to be touched by a hand of a person and the like.

The drive device 20 is mounted on a rear surface of the instrument main body 14. The drive device 20 has a function of supplying power to the light-emitting unit 13 of the substrate 12 in accordance with a command from the control device 22.

The control device 22 has a function of controlling the power supply from the drive device 20 to the light-emitting unit 13 of the substrate 12 on the basis of a signal received by the antenna 18. In this embodiment, the control device 22 is formed to be mounted on a printed board, and installed on the substrate 13 at one end portion of the illumination device 10 in the length direction X. The control device 22 can be electrically connected to the antenna 18 through a cable (not shown and can receive information included in the wireless signal received by the antenna 18.

Note that the antenna 18 and the control device 22 may be wirelessly connected to each other. In that case, power may be supplied to the antenna 18 by electromagnetic induction by an electromagnetic wave radiated from the control device 22, and information may be transmitted to the control device 22 from the antenna 18 with use of the power.

In this embodiment, the antenna 18 is arranged on the inner surface of the cover portion 16*a* at one end portion of the cover 16 in the length direction X. Therefore, in the illumination device 10, the control device 22 is arranged on one end portion of the instrument main body 14 facing the antenna 18 in the height direction Z, and a distance between the antenna 18 and the control device 22 becomes the shortest when the antenna 18 is arranged on the cover portion 16*a*. By arranging the control device as above, the electrical connection between the antenna 18 and the control device 22 can be easily ensured.

In the illumination device 10 having the abovementioned configuration, when a wireless signal commanding the lighting and the like, for example, is transmitted from the transmitter located outside the illumination device 10, the antenna 18 receives the wireless signal. The lighting command and the like received by the antenna 18 is transmitted to the control device 22. The control device 22 receives the lighting command and issues a command to the drive device 20 to supply power to the substrate 12. The drive device 20 receives the command and starts to supply power to the substrate 12. As a result, the light-emitting unit 13 of the substrate 12 emits light.

As described above, the illumination device 10 of this embodiment includes the substrate 12 including the light-emitting unit 13, the instrument main body 14 having the substrate arrangement surface 24 on which the substrate 12 is arranged, the cover 16 that is attached to the instrument main body 14 so as to cover the substrate 12 and that has transparency, and the antenna 18 that is arranged on the cover 16 and that receives a signal from the outside. In addition, the illumination device 10 further includes the drive device 20 that is mounted on the instrument main body 14 and that supplies power to the light-emitting unit 13, and the control device 22 that controls the power supply from the drive device 20 to the light-emitting unit 13 on the basis of the signal received by the antenna 18. Further, the cover 16 has a diffusion factor of from 40% to 90%.

Depending on the configuration, the diffusion factor of the cover 16 is from 40% to 90%, and hence the light applied from the light-emitting unit 13 is emitted while being diffused by the cover 16. Therefore, the antenna 18 provided on the cover 16 becomes inconspicuous. As a result, the deterioration of the design of the illumination device 10 can be suppressed.

In the illumination device 10 of this embodiment, the antenna 18 is preferably arranged on the inner surface of the cover 16 that is in contact with the space 15 formed between the instrument main body 14 and the cover 16. As a result, the antenna 18 is less likely to be touched by a hand of a person, and hence damage can be suppressed. Therefore, the occurrence of a communication failure can be suppressed.

Figure 3:
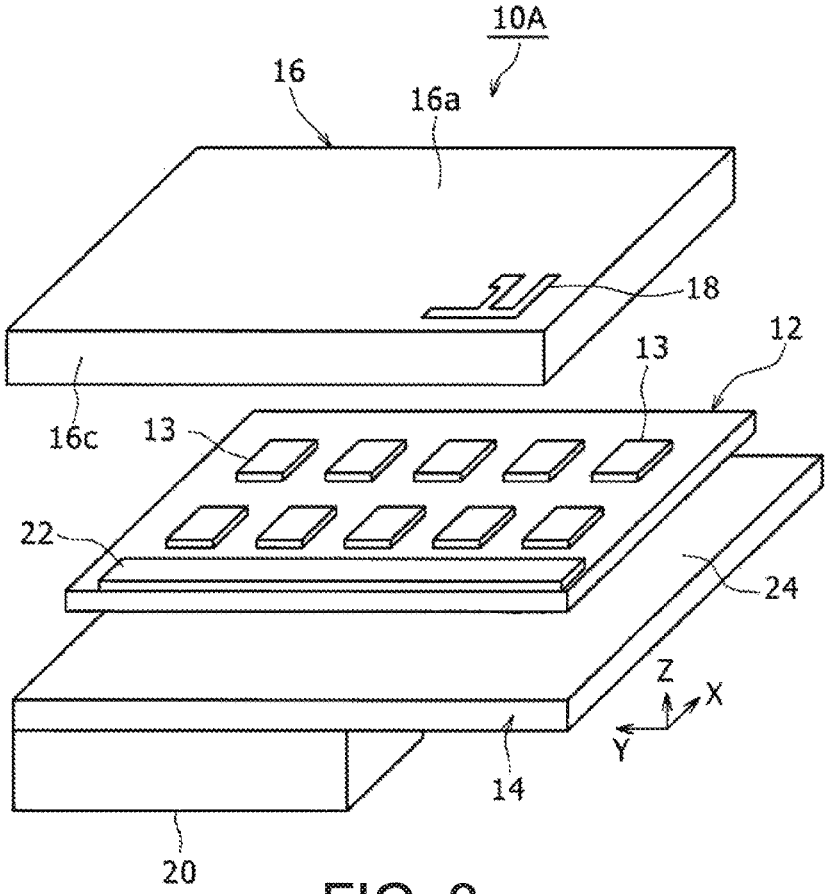
FIG. 3 is an exploded perspective view of an illumination device of a second embodiment.

Next, an illumination device 10A of the second embodiment is described with reference to FIG. 3. FIG. 3 is an exploded perspective view of the illumination device 10A of the second embodiment. In the following, features that are different from the illumination device 10 of the first embodiment described above are mainly described below. Structural elements that are the same as or similar to the illumination device 10 of the first embodiment described above are denoted by the same or similar reference characters and overlapping descriptions are not described.

As illustrated in FIG. 3, the illumination device 10A includes the substrate 12, the instrument main body 14, the cover 16, the drive device 20, and the control device 22.

On the substrate 12 in this embodiment, the plurality of light-emitting units 13 are arranged so as to be spaced apart from each other, and specifically arranged in a pattern of two rows and five columns.

The instrument main body 14 in this embodiment is formed by a flat plate forming a rectangular shape in planar view.

In this embodiment, the cover 16 has a rectangular shape in planar view, and the antenna 18 is arranged on an end portion of the cover 16. In more detail, the antenna 18 is arranged on the cover portion 16*a* of the cover 16 having a rectangular shape so as to be in the vicinity of one corner portion.

In this embodiment, the control device 22 is installed on one end portion of the substrate 12 having a rectangular shape in planar view in the length direction X. As a result, the control device 22 is arranged on the end portion of the instrument main body 14 having a rectangular shape in planar view, and is provided in a position facing the antenna 18 in the height direction Z.

Other configurations of the illumination device 10A are the same as those of the illumination device 10 of the first embodiment described above.

As described above, in the illumination device 10A of this embodiment, the cover 16 has a rectangular shape in planar view and the antenna 18 is arranged on an end portion of the cover 16. In addition, the control device 22 is arranged on an end portion of the instrument main body 14 facing the antenna 18. A similar effect as that of the illumination device 10 of the first embodiment described above can also be exhibited by the illumination device 10A having this configuration.

Figure 4:
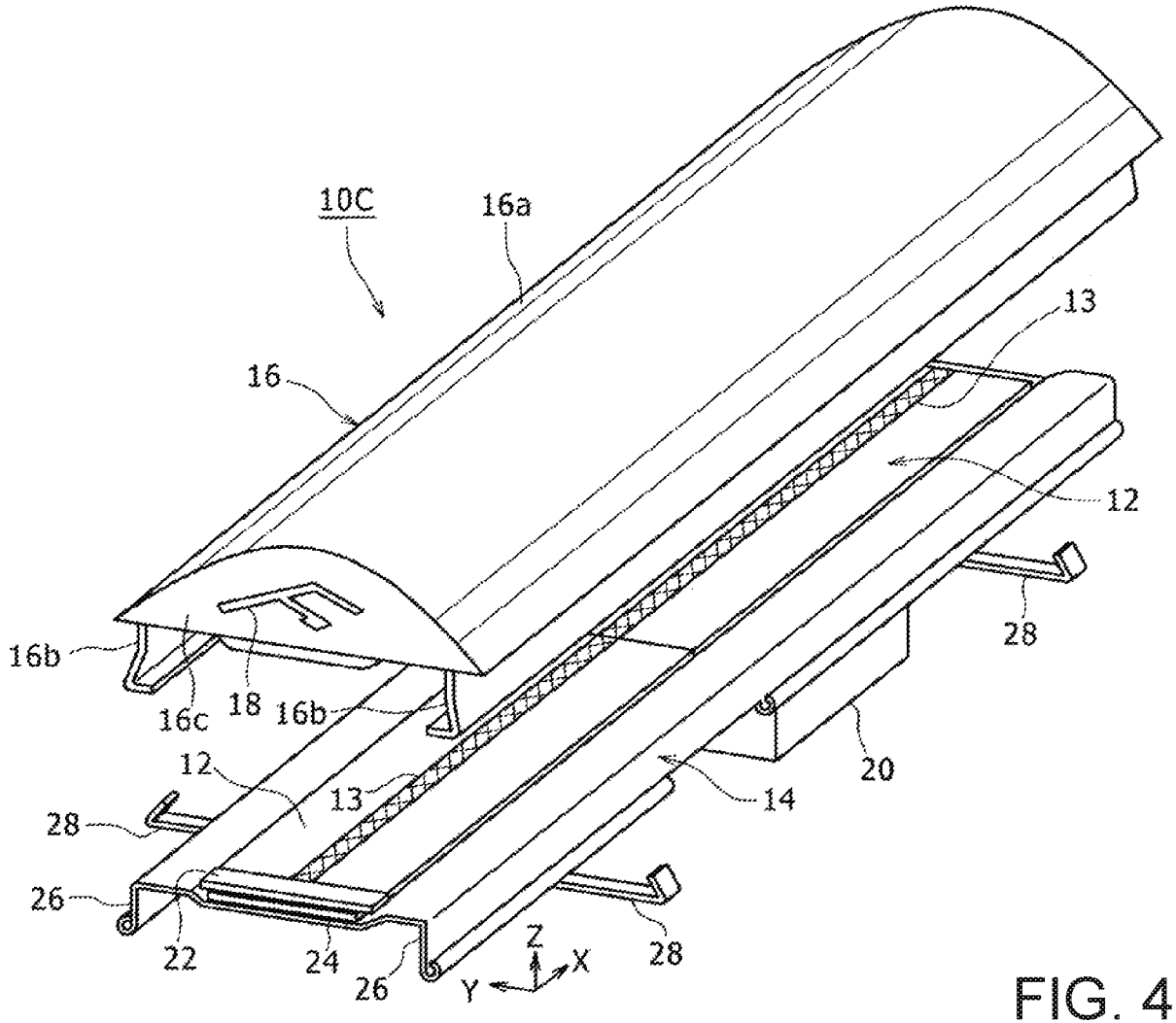
FIG. 4 is an exploded perspective view illustrating an illumination device that is a modified example of the first embodiment.

FIG. 4 is an exploded perspective view illustrating an illumination device 10C, that is a modified example of the first embodiment. Features that are different from the illumination device 10 of the first embodiment are mainly described below. The same structural elements are denoted by the same reference characters and overlapping descriptions are not described.

As illustrated in FIG. 4, the cover 16 of the illumination device 10C has the side surface 16*c* extending in a direction intersecting with the substrate arrangement surface 4 of the instrument main body 14, and the antenna 18 is arranged on the side surface 16*c*. In more detail, in the illumination device 10C, the control device 22 is arranged on one end portion in the length direction X, and the antenna 18 is arranged on the side surface 16*c* located on the same end portion as that on which the control device 22 is arranged. Other configurations of the illumination device 10C are the same as those of the illumination device 10 of the first embodiment. According to the illumination device 10C of this embodiment, a distance between the antenna 18 and the control device 22 becomes shorter than that in the illumination device 10 of the first embodiment, and hence the two can be electrically connected to each other in an easier and more reliable manner. In addition, when the antenna 18 is arranged on the side surface 16*c*, the antenna 18 becomes more inconspicuous compared to when the antenna 18 is arranged on the cover portion 16*a*, and hence the deterioration of the design can be suppressed.

Figure 5:
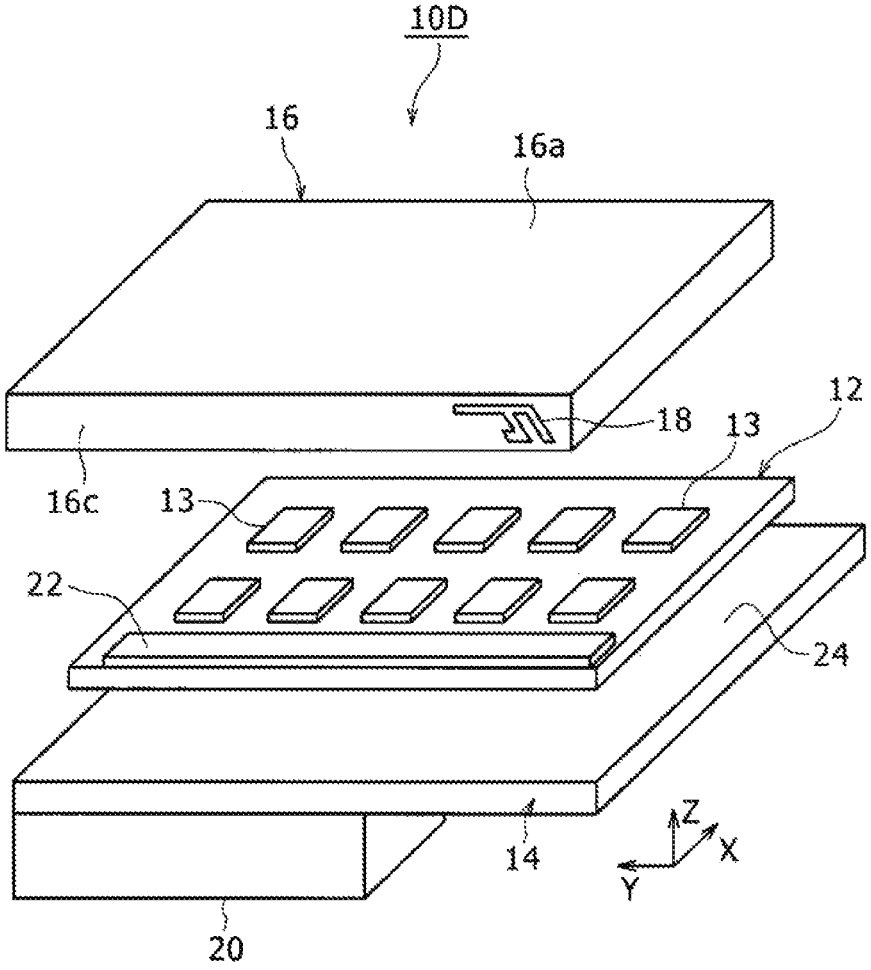
FIG. 5 is an exploded perspective view illustrating an illumination device that is a modified example of the second embodiment.

FIG. 5 is an exploded perspective view of an illumination device 10D that is a modified example of the second embodiment. Features that are different from the illumination device 10A of the second embodiment are mainly described below. The same structural elements are denoted by the same reference characters and overlapping descriptions are not described.

As illustrated in FIG. 5, the cover 16 of the illumination device 10D has a rectangular shape in planar view, and the antenna 18 is arranged on an end portion of the cover 16. In more detail, the cover 16 has the rectangular cover portion 16*a*, and four side surfaces 16*c* extending from edge portions on all sides of the cover portion 16*a* in a direction intersecting with the substrate arrangement surface 24 in a substantially perpendicular manner, and the antenna 18 is arranged on the side surface 16*c* located in the vicinity of an end portion of the substrate 12 on which the control device 22 is arranged. Other structural elements are the same as those of the illumination device 10A of the second embodiment described above. According to the illumination device 10D of this embodiment, a distance between the antenna 18 and the control device 22 becomes shorter than that in the illumination device 10A of the second embodiment, and hence the two can be electrically connected to each other in an easier and more reliable manner.

Figure 6:
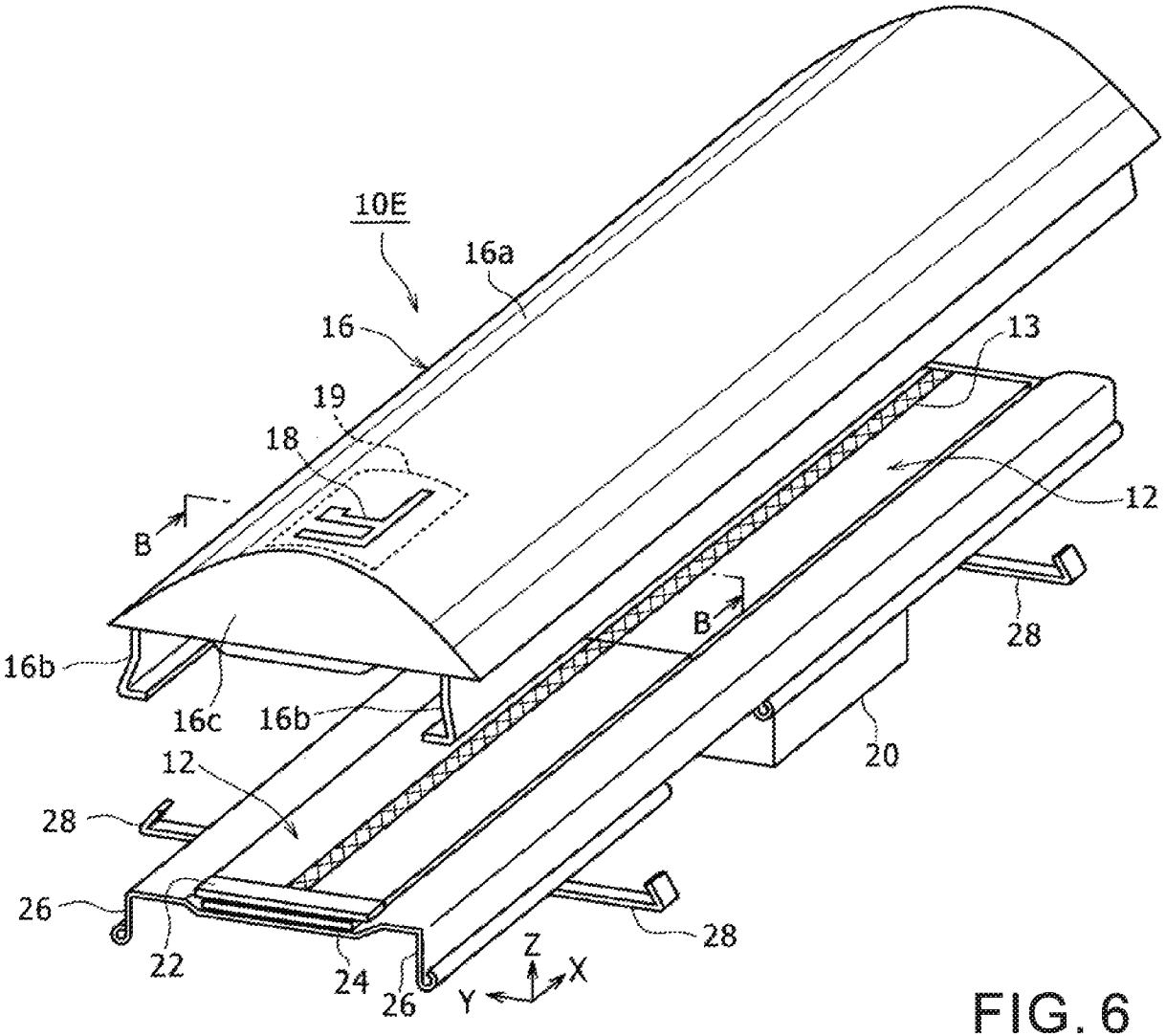
FIG. 6 is a perspective view illustrating an illumination device of yet another modified example of the first embodiment.
Figure 7:
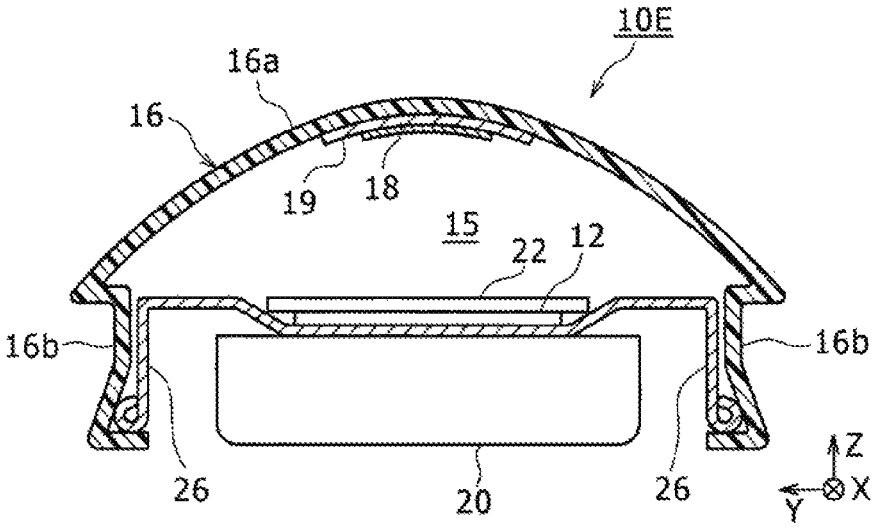
FIG. 7 is a sectional view of the illumination device illustrated in FIG. 6 in an assembled state taken along line B-B.

Next, yet another illumination device 10E of the first embodiment is described with reference to FIG. 6 and FIG. 7. FIG. 6 is a perspective view illustrating the illumination device 10E of this embodiment. FIG. 7 is a sectional view of the illumination device 10E illustrated in FIG. 6 in an assembled state taken along line B-B. Features that are different from the illumination device 10 of the first embodiment are mainly described below. The same structural elements are denoted by the same characters and overlapping descriptions are omitted.

As illustrated in FIG. 6 and FIG. 7, the antenna 18 is formed on a transparent base material 19, and the transparent base material 19 is bonded to the cover. The transparent base material 19 is suitably formed by a resin film, a glass plate, and the like, for example. In that case, the light transmittance of the transparent base material 19 is preferably 90% or more. By forming the pattern of the antenna 18 on the transparent base material 19 having a light transmittance as above and bonding the transparent base material 19 on the cover 16, the transparent base material 19 itself also becomes inconspicuous and the design deterioration of the illumination device 10E can be prevented. In addition, the pattern of the antenna 18 can be formed on the transparent base material 19, and hence the antenna 18 can be easily manufactured separately from the cover 16.

Figure 8A:
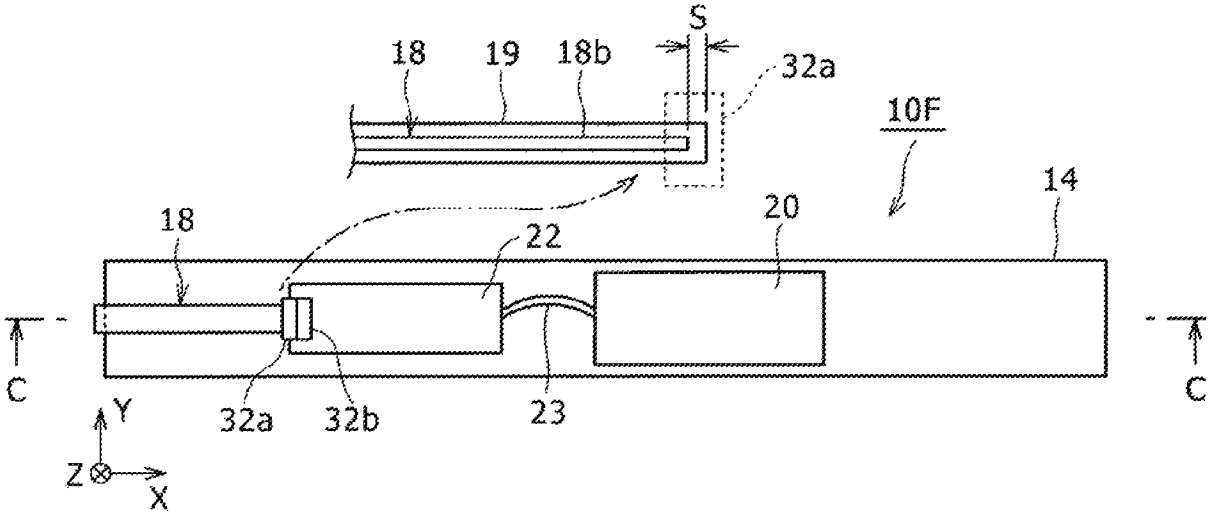
FIG. 8A is a top view of an illumination device of a third embodiment.
Figure 8B:
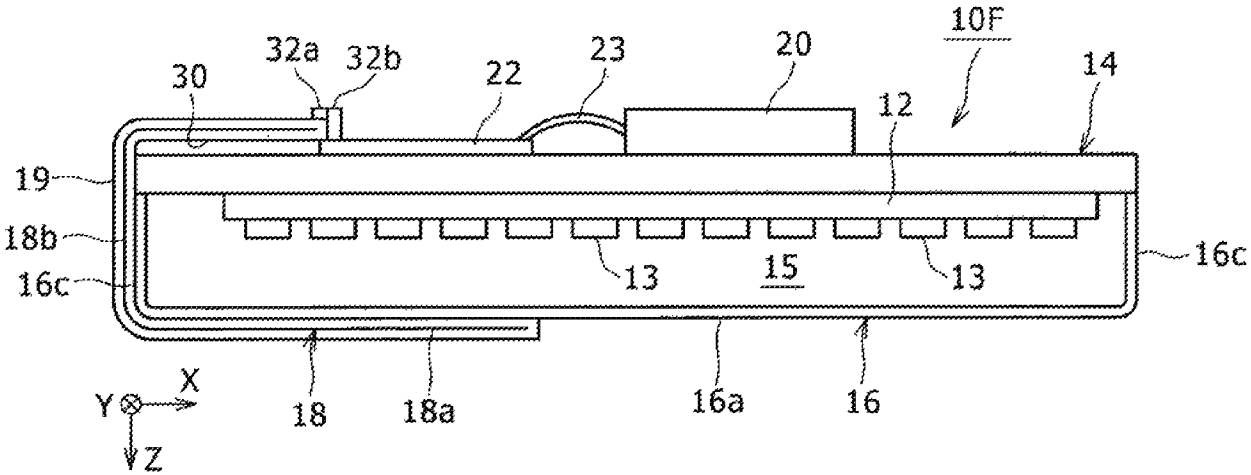
FIG. 8B is a sectional view taken along line C-C in FIG. 8A.

Next, an illumination device 10F of a third embodiment is described with reference to FIG. 8A and FIG. 8B. FIG. 8A is a top view of the illumination device 10F of the third embodiment, and FIG. 8B is a sectional view taken along line C-C in FIG. 8A. In the following, the features that are different from the illumination devices 10 to 10E of the first and second embodiments described above are mainly described. The structural elements same as or similar to the illumination devices 10 to 10E of the first and second embodiments described above are denoted by the same or similar reference characters and overlapping descriptions are not described.

As illustrated in FIGS. 8A and 8B, the drive device 20 and the control device 22 are installed on an upper surface of the instrument main body 14. The drive device 20 and the control device 22 are electrically connected to each other through an electrical wire 23, and a command relating to the power supply from the control device 22 to the drive device 20 is transmitted via the electrical wire 23.

Figure 9A:
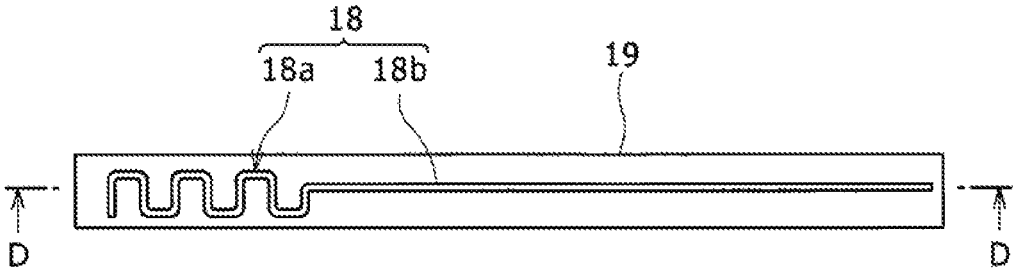
FIG. 9A is a plan view of an antenna formed on a transparent base material.
Figure 9B:
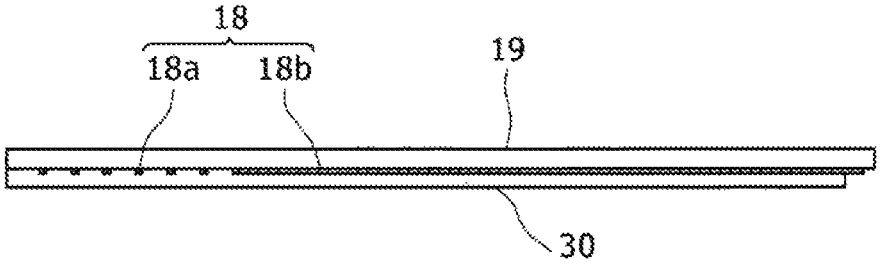
FIG. 9B is a sectional view taken along line D-D in FIG. 9A.

In the illumination device 10F, the antenna 18 is formed on the transparent base material 19 as illustrated in FIG. 9A and FIG. 9B. The antenna 18 includes a pattern portion 18*a* bent in a crank shape, and a conductive portion 18*b* that is connected to an end portion of the pattern portion 18*a* and extends linearly. In the antenna 18, the function of receiving a wireless signal is mainly realized by the pattern portion 18*a*, but the conductive portion 18*b* may also fulfill the function of receiving a wireless signal. Note that the shape of the pattern portion 18*a* of the antenna 18 may be other shapes such as an inverted F shape, for example.

The transparent base material 19 has a long-strip shape. The transparent base material 19 is suitably formed by a resin film, for example. The light transmittance of the transparent base material 19 is preferably 90% or more.

The antenna 18 is formed on a surface of the transparent base material 19 by metal plating and the like, for example. The line width of the conductive pattern line forming the antenna 18 is preferably from 0.1 mm to 0.5 mm, for example. In addition, the antenna 18 may be formed by a transparent conductive material such as ITO, for example.

The pattern portion 18*a* of the antenna 18 is formed on an end portion of the transparent base material 19 on one side thereof in a longitudinal direction. The conductive portion 18*b* of the antenna 18 has one end portion connected to the pattern portion 18*a* and another end portion located on an end portion on the other side of the transparent base material 19 in the longitudinal direction.

As illustrated in FIG. 9B, the antenna 18 formed on the transparent base material 19 is preferably covered with a transparent protection layer 30 formed by a resin material and the like, for example. By providing the protection layer 30 as above, the antenna 18 can be protected so as not to be damaged. The protection layer 30 is formed to be slightly shorter than the transparent base material 19. The protection layer 30 covers the pattern portion 18*a* and most parts of the conductive portion 18*b* of the antenna 18, but the end portion of the conductive portion 18*b* serving as a portion at which the antenna 18 is connected to the control device 20 is not covered with the protection layer 30 and is exposed. In addition, the protection layer 30 may be an adhesion layer.

When the protection layer 30 also serves as the adhesion layer, as above, the antenna 18 can be easily installed and fixed on the cover 16.

Referring to FIG. 8A and FIG. 8B again, the antenna 18 provided on the transparent base material 19 is arranged so that the pattern portion 18*a* is located on the outer surface (that is, a lower surface) of the cover portion 16*a* of the cover 16. In that case, the antenna 18 is preferably arranged by being bonded on the outer surface of the cover 16 by forming the protection layer 30 as an adhesion layer.

The transparent base material 19 on which the antenna 18 is formed extends from the cover portion 16*a* of the cover 16 to the upper surface of the instrument main body 14 along the side surface 16*c* on one side. The conductive portion 18*b* of the antenna 18 is formed on a part that extends as described above. Further, a connector 32*a* is coupled to the other side of the transparent base material 19 located on the upper surface of the instrument main body 14. The connector 32*a* is inserted in a connector coupling portion 32*b* provided in the control device 22. As a result, the transparent base material 19 on which the antenna 18 is formed is mechanically connected to the control device 22, and the conductive portion 18*b* of the antenna 18 is electrically connected to the control device 22.

As a result, in the illumination device 10F, the electrical connection of the antenna 18 to the control device 22 becomes easier and the productivity is enhanced because the soldering process becomes unnecessary, compared to when the antenna 18 and the control device 22 are electrically connected to each other through an electrical cable. In addition, the antenna 18 can be formed with a material (for example, nickel or a nonmetallic conductive material) on which soldering is difficult. In addition, when the protection layer 30 is an adhesion layer, the installation of the antenna 18 becomes easier and the productivity of the illumination device is enhanced. Further, by forming the antenna formed on the transparent base material itself to be electrically connected to the control device 22, there is no need to use an electrical cable. Therefore, the visibility from the outside of the cover when the illumination is lighted is largely reduced. As a result, the deterioration of the design can be suppressed.

Note that as illustrated in a partially enlarged view in the upper part of FIG. 8A, an end of the conductive portion 18*b* of the antenna 18 may be located further inward than an end edge portion of the transparent base material 19 by a size S of from about 1 mm to about 10 mm, for example. A terminal of the connector 32*a* only needs to be electrically connected to the end of the conductive portion 18*b* located on the inner side, as described above.

Figure 10A:
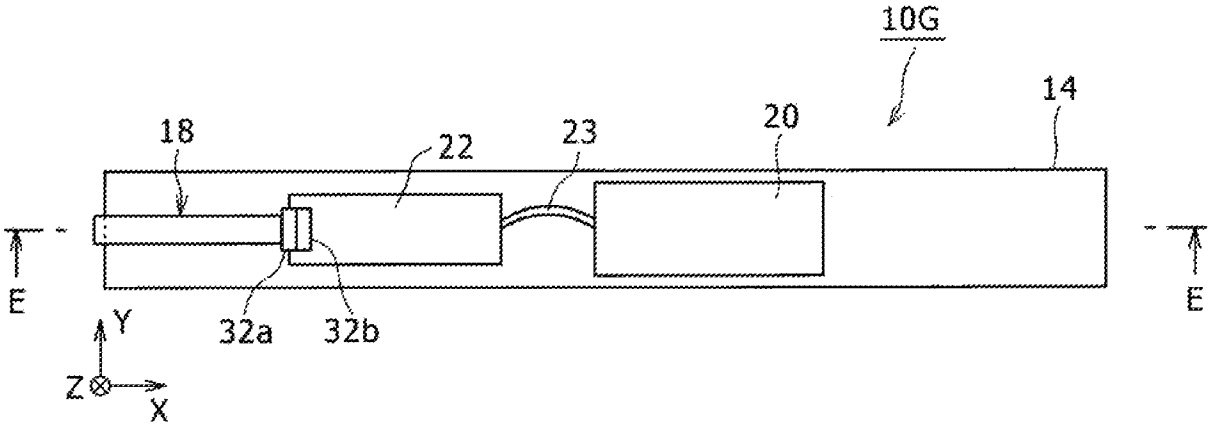
FIG. 10A is a top view of an illumination device of a fourth embodiment.

Next, an illumination device 10G of a fourth embodiment is described with reference to FIG. 10A and FIG. 10B. FIG. 10A is a top view of the illumination device of the fourth embodiment, and FIG. 10B is a sectional view taken along line E-E in FIG. 10A.

Figure 10B:
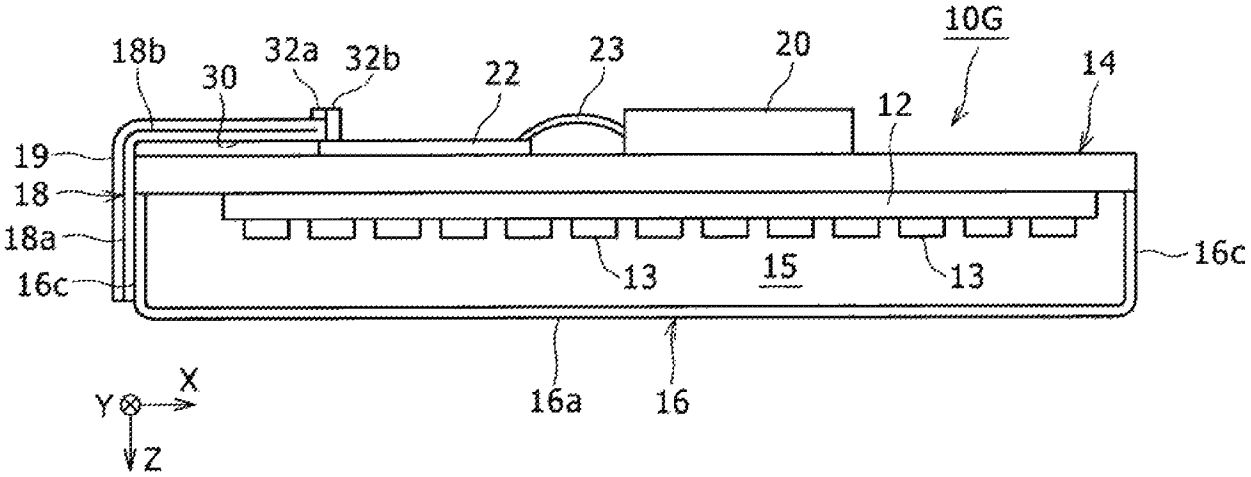
FIG. 10B is a sectional view taken along line E-E in FIG. 10A.

As illustrated in FIG. 10A and FIG. 10B, in the illumination device 10G of this embodiment, an end portion of the transparent base material 19 is located on the side surface 16*c* of the cover 16 on one side thereof in the longitudinal direction. That is, in the illumination device 10G, the pattern portion 18*a* of the antenna 18 is arranged on the side surface 16*c* of the cover 16. In other words, the antenna 18 is not arranged on the cover portion 16*a* of the cover 16. Structural elements other than the above are similar to those of the illumination device 10F of the third embodiment described above. According to the illumination device 10G of this embodiment, the antenna 18 and the transparent base material 19 are arranged on the side surface 16*c* of the cover 16 and are not arranged on the cover portion 16*a*, and hence the antenna 18 becomes more inconspicuous and the deterioration of the design can be suppressed even more.

Figure 11A:
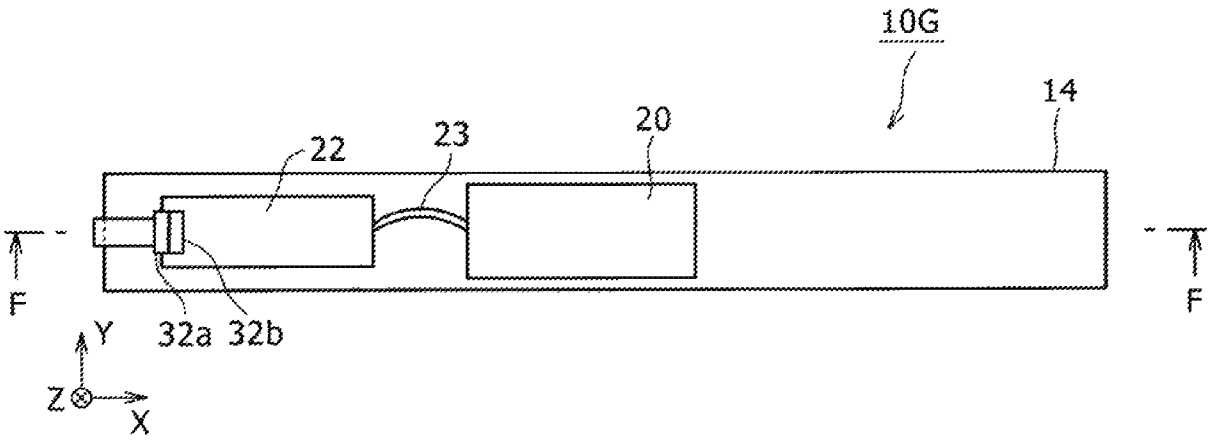
FIG. 11A is a top view illustrating a modified example of the illumination device of the fourth embodiment.
Figure 11B:
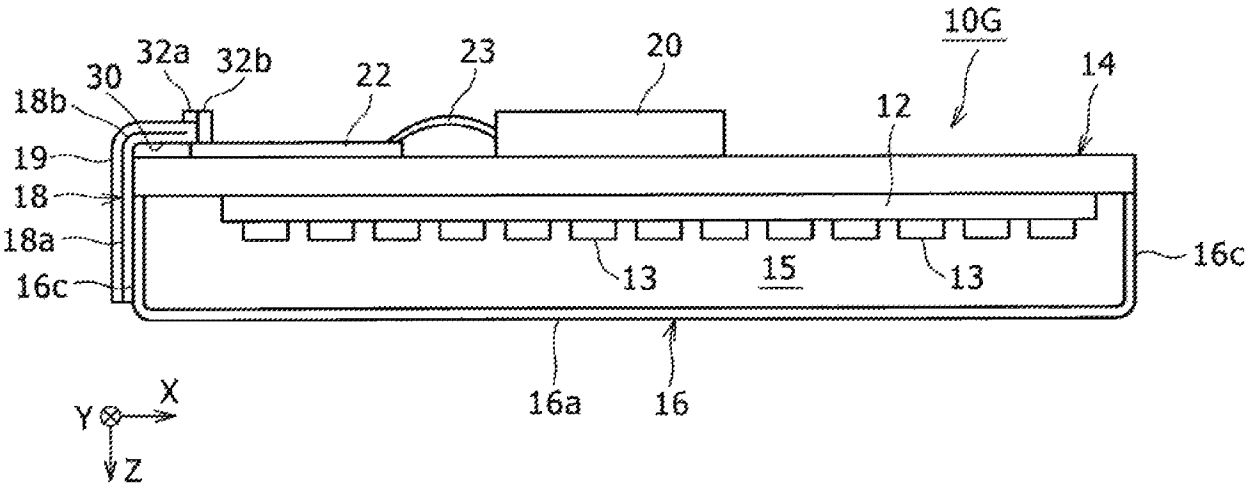
FIG. 11B is a sectional view taken along line F-F in FIG. 11A.

Note that as illustrated in FIG. 11A and FIG. 11B, in the illumination device 10G, the control device 22 may be installed close to an end portion of the instrument main body 14 in the longitudinal direction. As a result, the antenna 18 can be connected to the control device 22 in an easier manner. In addition, the length (area) of the antenna 18 and the transparent base material 19 can be reduced.

Figure 12A:
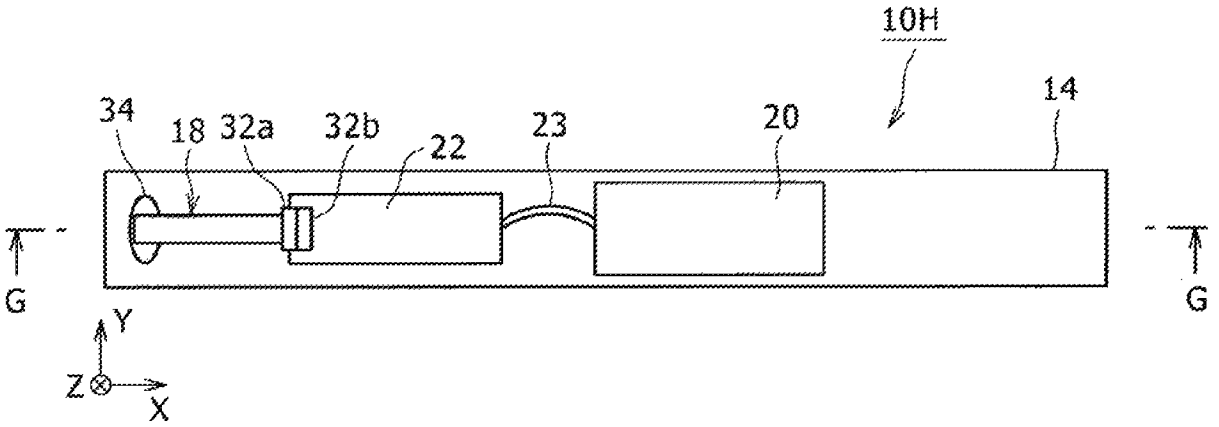
FIG. 12A is a top view of an illumination device of a fifth embodiment.

Next, an illumination device 10H of a fifth embodiment is described with reference to FIG. 12A and FIG. 12B. FIG. 12A is a top view of the illumination device 10H of the fifth embodiment, and FIG. 12B is a sectional view taken along line G-G in FIG. 12A.

Figure 12B:
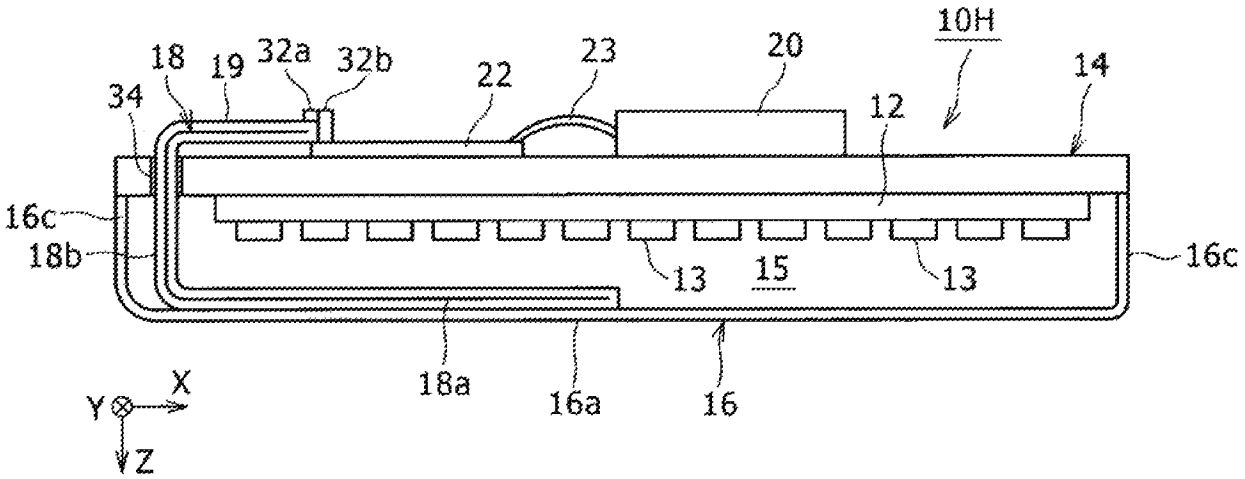
FIG. 12B is a sectional view taken along line G-G in FIG. 12A.

As illustrated in FIG. 12A and FIG. 12B, in the illumination device 10H, a through hole 34 is formed in an end portion of the instrument main body 14 in the longitudinal direction. The antenna 18 formed on the transparent base material 19 is inserted in the cover 16 through the through hole 34 in the instrument main body 14. The pattern portion 18*a* of the antenna 18 is formed on an end portion of the transparent base material 19 arranged in the cover 16. In that case, the antenna 18 may be bonded on the inner surface of the cover 16 via the transparent base material 19 or the protection layer 30, or only needs to be arranged so as to be in contact with the inner surface of the cover 16. Other structural elements of the illumination device 10H are similar to those of the illumination device 10F of the third embodiment described above.

In that case, the cover 16 has a diffusion factor of from 40% to 90%, and hence the visibility of the pattern portion 18*a* of the antenna 18 and the transparent base material 19 arranged in the cover 16 from the outside of the cover when the illumination is lighted is reduced. As a result, the design of the illumination device is enhanced. In addition, at least the pattern portion 18*a* of the antenna 18 is arranged in the cover 16, and hence the protection of the antenna 18 becomes more reliable.

Figure 13A:
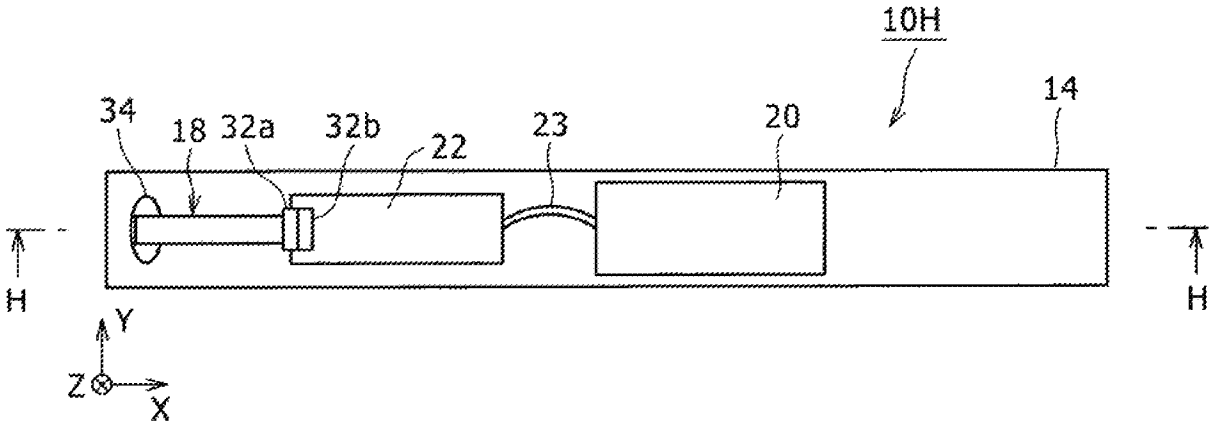
FIG. 13A is a top view illustrating a modified example of the illumination device of the fifth embodiment.
Figure 13B:
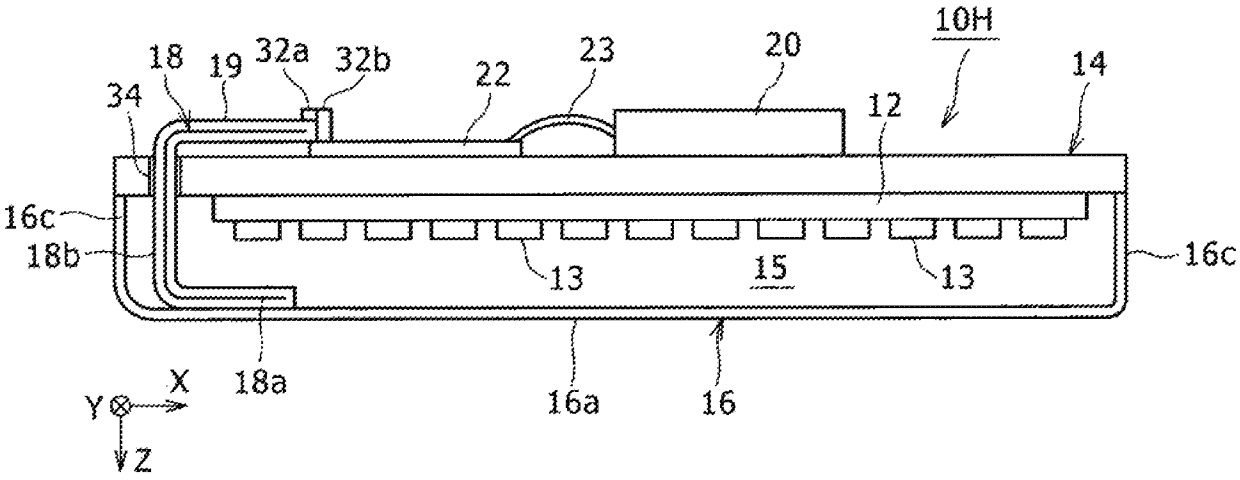
FIG. 13B is a sectional view taken along line H-H in FIG. 13A.

Note that, an example in which the end portion of the transparent base material 19 on which the pattern portion 18*a* of the antenna 18 is formed is arranged so as to extend to the central portion of the illumination device 10H in the longitudinal direction is illustrated in FIG. 12A and FIG. 12B, but the present invention is not limited thereto. As illustrated in FIG. 13A and FIG. 13B, the end portion of the transparent base material 19 on which the pattern portion 18*a* is formed may be located on an end portion of the illumination device 10H in the longitudinal direction. According to this configuration, the visibility of the pattern portion 18*a* of the antenna 18 and the transparent base material 19 from the outside of the cover when the illumination is lighted can be reduced further, and hence the design of the illumination device 10H can be further enhanced. In addition, the length (and the area) of the transparent base material 19 can be reduced.

Figure 14A:
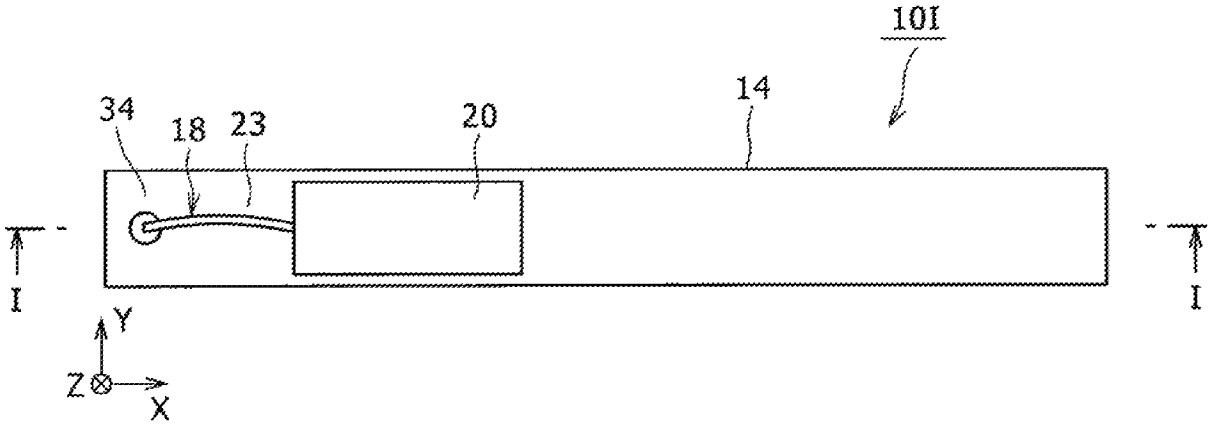
FIG. 14A is a top view of an illumination device of a sixth embodiment.

Next, an illumination device 10I of a sixth embodiment is described with reference to FIG. 14A and FIG. 14B. FIG. 14A is a top view of the illumination device 10I of the sixth embodiment, and FIG. 14B is a sectional view taken along line I-I in FIG. 14A.

Figure 14B:
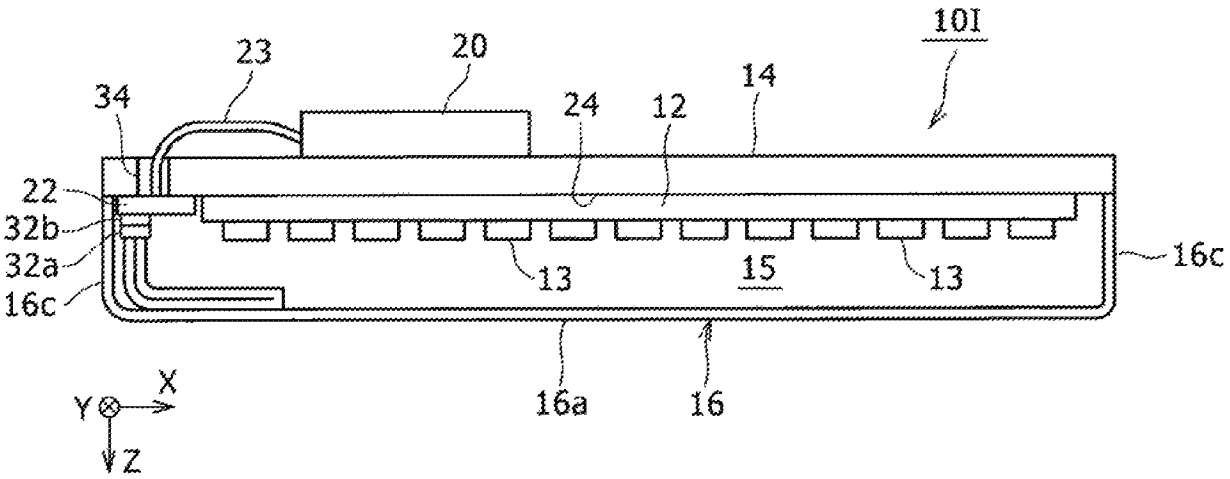
FIG. 14B is a sectional view taken along line I-I in FIG. 14A.

As illustrated in FIG. 14A and FIG. 14B, in the illumination device 10I, the control device 22 is arranged on a lower surface of the instrument main body 14, that is, the substrate arrangement surface 24. The control device 22 is arranged on an end portion of the instrument main body 14 in the longitudinal direction. In that case, the drive device 20 is also preferably installed at a position closer to the end portion side than the central portion of the instrument main body 14 in the longitudinal direction. As a result, the operation of connecting the control device 22 and the drive device 20 to each other with the electrical wire 23 becomes easier. In addition, the control device 22 may be fixed to the instrument main body 14 through a screw, adhesion, and the like, for example. Other structural elements of the illumination device 10I are similar to those of the illumination device 10F of the third embodiment described above.

According to the illumination device 10I of this embodiment, the visibility of the pattern portion 18*a* of the antenna 18 and the transparent base material 19 from the outside of the cover when the illumination is lighted can be further reduced, and hence the design of the illumination device 10I is further enhanced. In addition, the entire antenna 18 is arranged in the cover 16, and hence the protection of the antenna 18 becomes more reliable.

Note that the illumination device according to the present disclosure is not limited to the abovementioned embodiments and the modified examples thereof, and it goes without saying that various improvements and modifications can be made within the scope of the claims of the present disclosure.

REFERENCE SIGNS LIST 10, 10A, 10C, 10D, 10E
illumination device, 12
substrate, 13
light-emitting unit, 14
instrument main body, 15
space, 16
cover, 16a
cover portion, 16b
attachment portion, 16c
side surface, 18
antenna, 18a
pattern portion, 18b
conductive portion, 19
transparent base material, 20
drive device, 22
control device, 23
electrical wire, 24
substrate arrangement surface, 26
bent portion, 28
attachment portion, 30
protection layer, 32a
connector, 32b
connector coupling portion, 34
through hole

The invention claimed is:

1. An illumination device, comprising:
a substrate including a light-emitter;
an instrument main body including a substrate arrangement surface, the substrate being on the substrate arrangement surface;
a cover that is attached to the instrument main body, covers the substrate, and is transparent;
an antenna on the cover and configured to receive a signal from an outside of the illumination device;
a driver on the instrument main body and configured to supply power to the light-emitter; and
a controller configured to control the power supplied from the driver to the light-emitter based on the signal received by the antenna,
wherein the cover includes a diffusion factor from 40% to 90%, and
the cover includes a side surface extending in a direction intersecting with the substrate arrangement surface, and the antenna is on the side surface.

2. The illumination device according to claim 1, wherein the antenna is on an inner surface of the cover, the inner surface being in contact with a space that is between the instrument main body and the cover.

3. An illumination device, comprising:
a substrate including a light-emitter;
an instrument main body including a substrate arrangement surface, the substrate being on the substrate arrangement surface;
a cover that is attached to the instrument main body, covers the substrate, and is transparent;
an antenna on the cover and configured to receive a signal from an outside of the illumination device;
a driver on the instrument main body and configured to supply power to the light-emitter; and
a controller configured to control the power supplied from the driver to the light-emitter based on the signal received by the antenna,
wherein the cover includes a diffusion factor from 40% to 90%, and
the cover includes a rectangular shape in a planar view, and the antenna is on an end portion of the cover.

4. The illumination device according to claim 3, wherein the controller is on an end portion of the instrument main body and faces the antenna.

5. An illumination device, comprising:
a substrate including a light-emitter;
an instrument main body including a substrate arrangement surface, the substrate being on the substrate arrangement surface;
a cover that is attached to the instrument main body, covers the substrate, and is transparent;
an antenna on the cover and configured to receive a signal from an outside of the illumination device;
a driver on the instrument main body and configured to supply power to the light-emitter; and
a controller configured to control the power supplied from the driver to the light-emitter based on the signal received by the antenna,
wherein the cover includes a diffusion factor from 40% to 90%,
the antenna is on a transparent base material,
the transparent base material is mechanically connected to the controller, and
the antenna is electrically connected to the controller.

6. The illumination device according to claim 5, wherein the transparent base material is bonded to the cover.

7. The illumination device according to claim 5, wherein the antenna is on an end portion of the transparent base material in a longitudinal direction.

8. The illumination device according to claim 5, wherein the transparent base material includes a light transmittance of at least 90%.

9. The illumination device according to claim 5, wherein a first portion of the antenna, other than a second portion of the antenna to be connected to the controller, is covered by a transparent protection layer.

10. The illumination device according to claim 5, wherein the antenna includes a conductive pattern line, and a width of the conductive pattern line is from 0.1 mm to 0.5 mm.

11. The illumination device according to claim 5, wherein the antenna is composed of a transparent conductive material.

12. The illumination device according to claim 5, wherein the antenna is on an inner surface of the cover, the inner surface and the antenna being curved.

13. The illumination device according to claim 5, wherein the antenna is on a transparent base material, the transparent base material including a long-strip shape that extends in a first direction, and the antenna includes first portions that extend parallel to the first direction and second portions that extend perpendicular to the first direction.

14. An illumination device, comprising:

a substrate including a light-emitter;

an instrument main body including a substrate arrangement surface, the substrate being on the substrate arrangement surface;

a cover that is attached to the instrument main body, covers the substrate, and is transparent;

an antenna on the cover and configured to receive a signal from an outside of the illumination device;

a driver on the instrument main body and configured to supply power to the light-emitter; and a controller configured to control the power supplied from the driver to the light-emitter based on the signal received by the antenna, wherein the cover includes a diffusion factor from 40% to 90%, the antenna and the controller are wirelessly connected, and the power is supplied from the controller to the antenna by electromagnetic induction.

15. The illumination device according to claim 14, wherein the antenna is on a transparent base material, and the transparent base material includes a light transmittance of at least 90%.

16. The illumination device according to claim 14, wherein the antenna is on a transparent base material, the antenna is covered with a transparent protection layer, and the transparent protection layer is an adhesion layer.

17. The illumination device according to claim 14, wherein the antenna is bonded to the cover via a transparent layer.

* * * * *